US005219071A

United States Patent [19]

Knapp

[11] Patent Number: 5,219,071

[45] Date of Patent: Jun. 15, 1993

[54] JEWELRY PACKAGE

[75] Inventor: Robert L. Knapp, Akron, Ohio

[73] Assignee: Sterling Inc., Akron, Ohio

[21] Appl. No.: 754,395

[22] Filed: Sep. 3, 1991

[51] Int. Cl.[5] ..... B65D 73/00; B65D 75/04

[52] U.S. Cl. ..... 206/6.1; 206/479; 229/87.01; 229/87.15

[58] Field of Search ..... 206/6.1, 477–479, 206/483, 493, 495, 566; 229/87.01, 87.15, 92.5, 92.7

[56] References Cited

U.S. PATENT DOCUMENTS

| | | | |
|---|---|---|---|
| 850,408 | 4/1907 | Sullivan | 206/478 |
| 1,429,608 | 9/1922 | May | 229/87.15 |
| 1,526,122 | 2/1925 | Dau | 206/479 |
| 2,033,526 | 3/1936 | Kinkenon | 229/87.01 |
| 2,269,915 | 1/1942 | Porter | 229/87.15 |
| 2,535,229 | 12/1950 | Paolantonio | 206/479 |
| 2,861,680 | 11/1958 | Frasch | 229/87.01 |
| 4,880,117 | 11/1989 | Garganese | 206/482 |

*Primary Examiner*—Jimmy G. Foster
*Attorney, Agent, or Firm*—Reese Taylor

[57] ABSTRACT

A package for displaying and presenting jewelry includes a planar base having foldable top flaps secured to its periphery whereby the flaps may be folded over the base to provide a closed package. One or more pairs of through slits are provided in the base and a ribbon is threaded through the slits so that part of the ribbon provides a means for securing the jewelry to the base and the remainder of the ribbon may be wrapped around the closed package to secure it. Some of the top flaps may be provided with an inter-engaging lip and slot to secure the flaps in the closed position and the outer surfaces of the base and top flaps may be decorated.

6 Claims, 5 Drawing Sheets

JEWELRY PACKAGE

BACKGROUND OF THE INVENTION

This invention relates in general to packaging for small objects and relates in particular to a unique low-cost package for articles of jewelry, such as chains, necklaces or the like, in which the means for securing the jewelry article within the package also serve to constitute a decorative outer securing means for the package itself.

DESCRIPTION OF THE PRIOR ART

As is well-known, small articles such as jewelry, including chains, necklaces and the like, are displayed in a number of ways in the retail market. They are also packaged and boxed for gift purposes in a number of ways.

One of these ways involves utilization of a foldable package which has a base, cover means which fold over the base and strap and snap means which can secure the article on the base so as to present an attractive presentation mode for the article. As mentioned, such a package conventionally has soft, fold over flaps which cover the article and opposed end flaps which fold over and snap together so as to present a relatively flat package which can be sued for presentation to the recipient. These packages normally can then be either inserted into a conventional cardboard box, following which the box can be decorated with wrapping paper, or the package itself could simply be decorated with the wrapping paper.

Obviously, such a device is functionally efficient for the purpose for which it is designed. However, these conventional packages are relatively expensive, both due to the nature of the material from which they are made and due to certain mechanical devices which are necessarily required to retain the articles in place and to secure the package in its closed position. As to the material, these packages generally have a soft base upon which the article lies and leather or simulated leather is utilized for the flaps. Furthermore, the jewelry article is secured by mating male and female snap members as are the cover flaps. All of this, of course, adds to the cost of the package, both in the acquisition of the hardware and other materials and in the manufacturing process.

These packages also, as noted, generally require the use of decorative boxes or paper, particularly when the jewelry article is intended to be used as a gift.

Accordingly then, it is through desirable to provide a low-cost, yet functionally effective package for jewelry and the like which can be made of relatively inexpensive material and wherein no hardware whatsoever is required with the means for securing the jewelry article within the package serving the additional purpose of serving as a decorative member for closing the package.

SUMMARY OF THE INVENTION

It accordingly becomes the principal object of this invention to produce a low-cost, yet attractive and functionally effective jewelry package.

In furtherance of that object, it has been found that the package itself can be constructed from a relatively inexpensive material, such as cardboard or the like, which is die cut so as to form a flat blank having a base, side walls and top flaps which are foldable so as to present, in the finished product, a compact, flat package.

It has also been found that, by utilizing material of the type just described, the exterior surface of the material can be printed or embossed with decorative designs so that when the package is closed, a pleasing aesthetic effect can be achieved without the need for utilization of a decorative box or wrapping paper.

It has further been found that the hardware of the prior art can be eliminated by providing through slots in the base through which is threaded a decorative ribbon which serves the dual purpose of retaining the jewelry article on the base during transportation of the package and presenting means for securing the package in a closed position by wrapping the ends of the ribbon about the exterior of the closed package and tying them into a bow.

Accordingly, production of an improved jewelry package of the type above-described becomes the principal object of this invention with further objects thereof becoming more apparent upon a reading of the following brief specification considered and interpreted in view of the accompanying drawings.

BRIEF DESCRIPTION OF THE PREFERRED EMBODIMENTS

Figure 5:
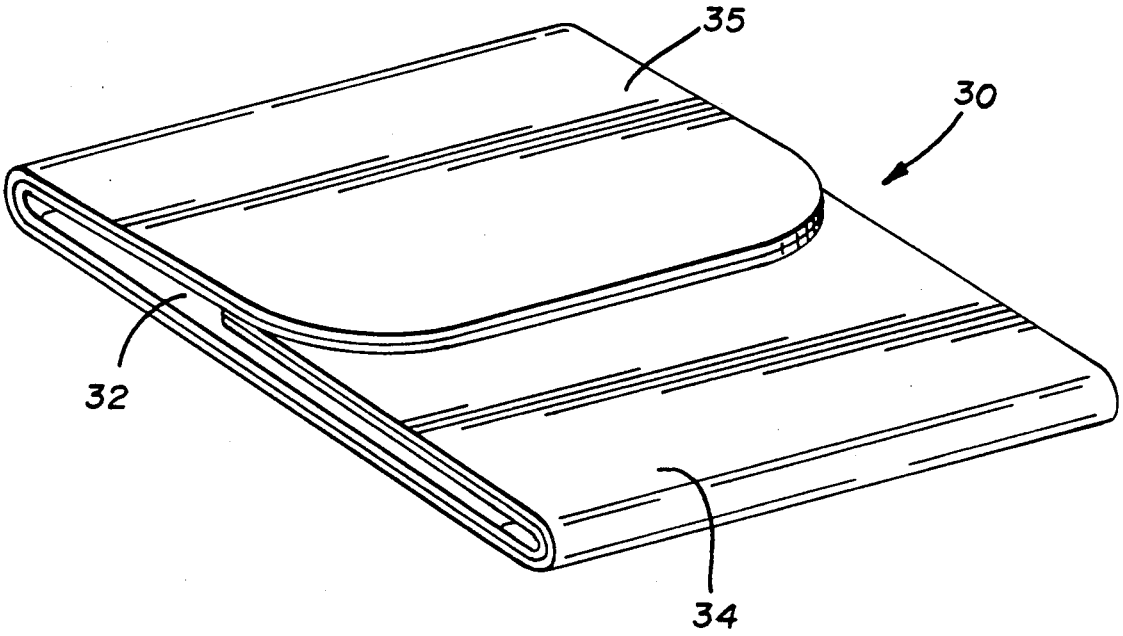
FIG. 5 PRIOR ART
FIG. 5 is a perspective view of a typical prior art package.
Figure 6:
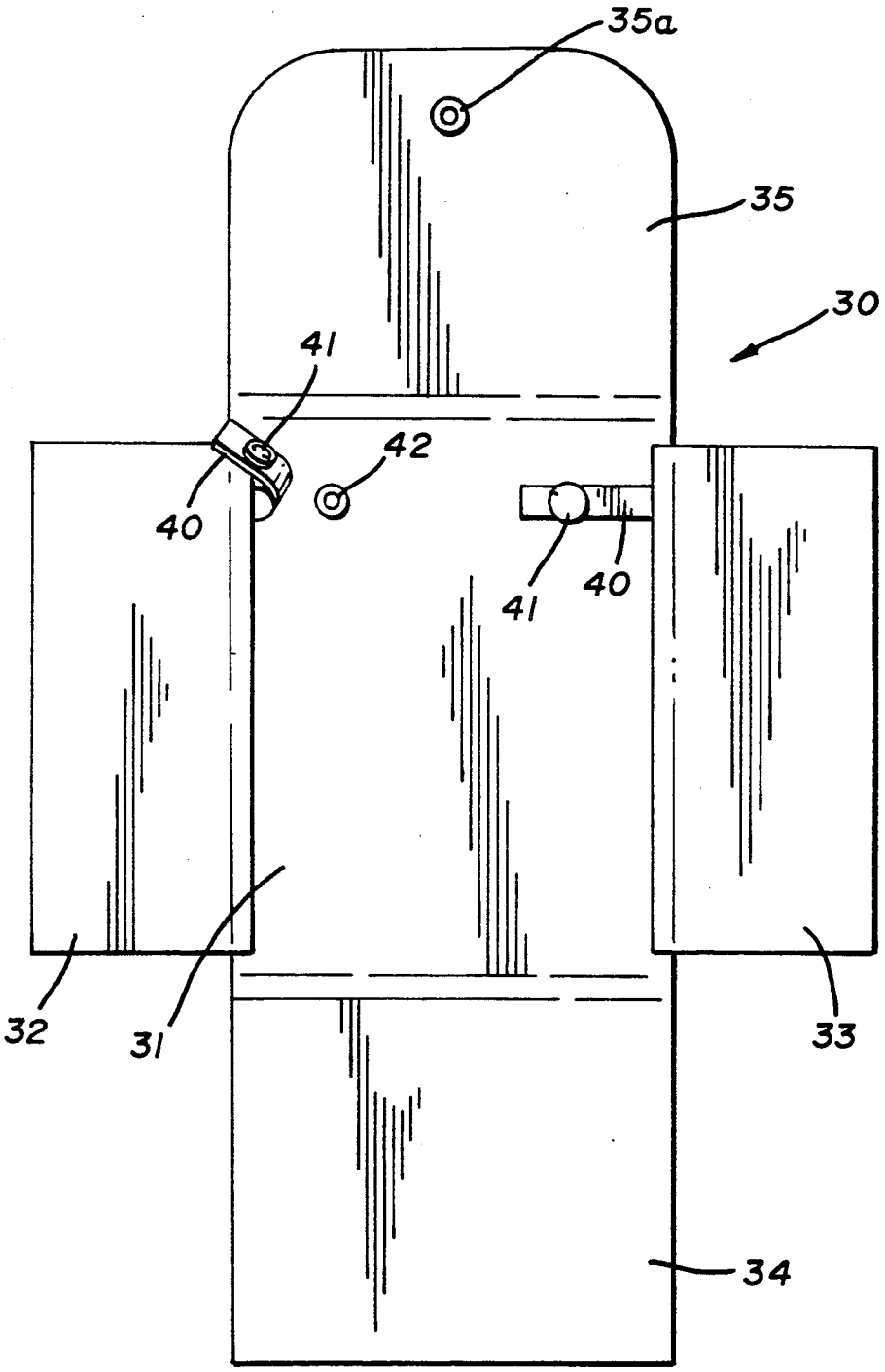
FIG. 6 PRIOR ART
FIG. 6 is a top plan view of a typical prior art package in the open condition.

Before discussing the improved package, reference is first had to FIGS. 5 and 6 which depict the most common prior art package known to Applicant.

Thus, it will be seen from FIGS. 5 and 6 that the prior art package, generally indicated by the numeral 30, has a flat base member 31 and soft fabric cover members 32 and 33 which are designed to fold over the base 31 and lie in covering position therewith.

Opposed end flaps 34 and 35 of the prior art are also provided and are hinged to the base 31 so that they may be folded over, in turn, to also be positioned in overlying relationship with the base 31. A male snap **35*a* is received on the inner surface of the end flat 35 and a female snap member (now shown) is received on the outer surface of the flap 34 so that when the flaps are folded over to the position of FIG. 5, flaps 34 and 35** can be snapped together.

Also received on the base 31 are strap members which are stitched or otherwise secured to the base and are indicated by the numeral 40. These straps carry female snap members 41 which are engagable with male snap members 42 which, in turn, are attached to the base 31. In this way, the jewelry article, such as, for example, a chain or necklace, can be laid on the surface of the base 31 and secured in place by the strap and snap arrangements 41 and 42.

Turning then to FIGS. 1 through 4 for a description of the present invention, it will be seen that the improved package, generally indicated by the numeral 10, includes a base 11 and first and second opposed side walls 12 and 13. As mentioned previously, it is intended that the package be made of relatively inexpensive material, such as heavy paper or cardboard, and to that end, the side walls 12 and 13 are integral with the base 11 and joined thereto by score or fold lines 11*a*,11*a*. This makes it possible to fold side walls 12 and 13 along these lines so that they are disposed generally perpendicular to the plane of the base 11.

First and second top flaps 16 and 17 are also integral with the side walls 12 and 13 and score lines 12*a* and 13*a* are also provided so that the first and second top flaps 16 and 17 can be folded along those lines so as to generally overlie the base 11.

Opposed end walls 14 and 15 are also integral with the base 11 and score lines 11*a*,11*a* again interconnect them and make it possible to fold the end walls 14 and 15 to a position generally perpendicular to the plane of the base 11.

Also secured to end walls 14 and 15 are third and fourth top flaps 18 and 19 and, again, score lines 14*a* and 15*a* make it possible to fold the third and fourth end flaps 18 and 19 so that they overlie the base 11.

Figure 1:
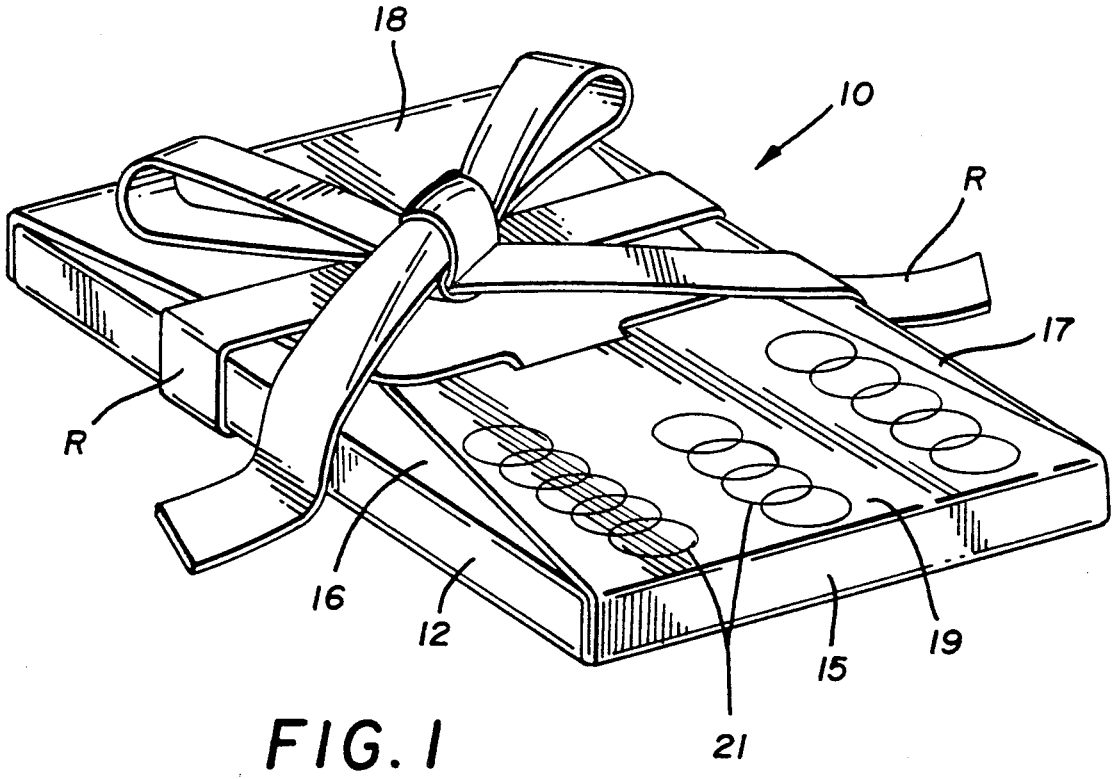
FIG. 1 is a perspective view of the improved package in its closed position.

It will be noted that, in the form of the invention illustrated, third top flap 18 has a projecting lip 18*a* and fourth top flap 19 has a through slot 19*a* which permits these flaps to be interengaged, as shown in FIG. 1 of the drawings. It will be understood, however, that it would not absolutely be necessary to employ this type of engagement means or, for that matter, any engagement means at all, as will subsequently be described.

Figure 2:
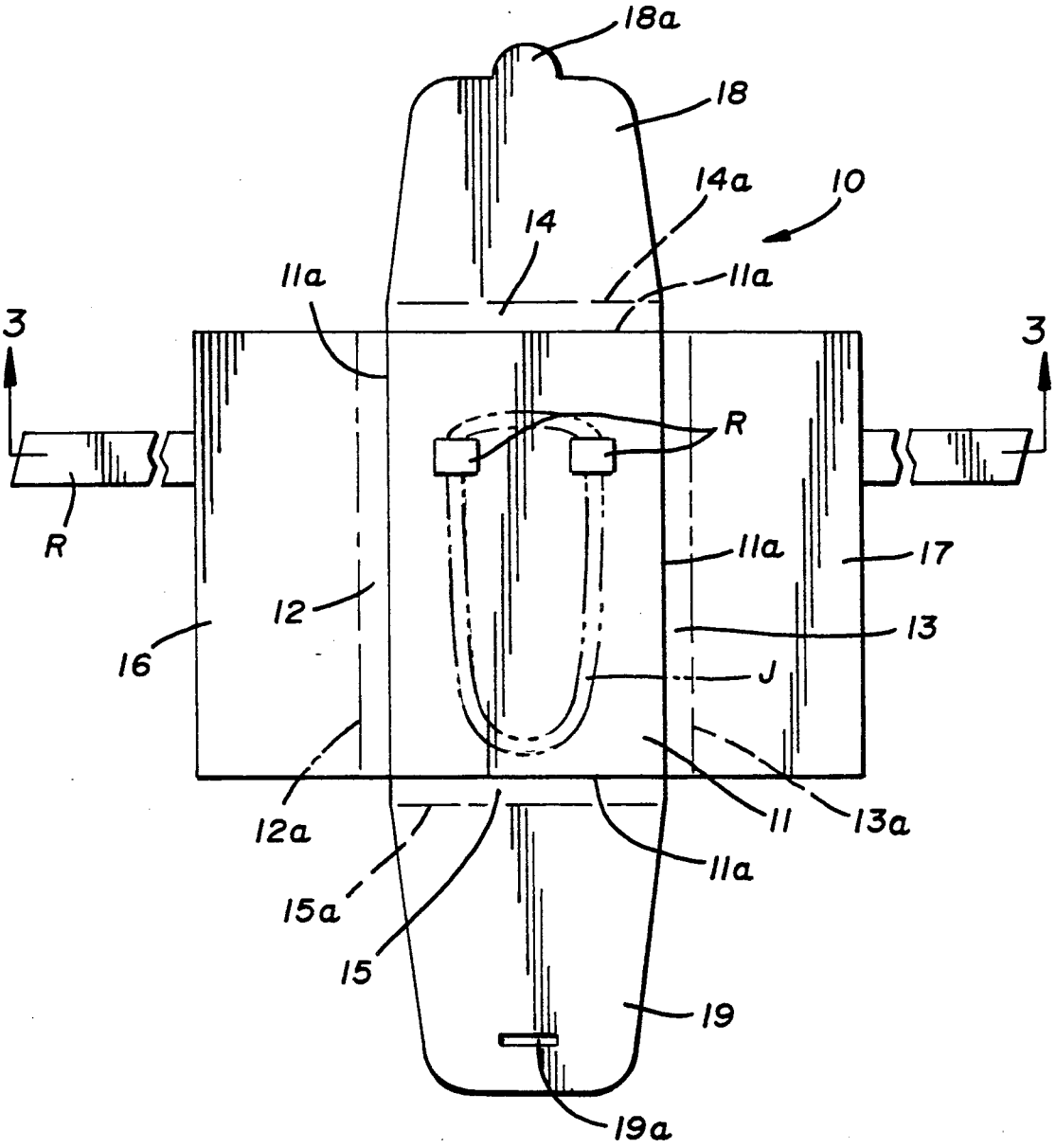
FIG. 2 is a top plan view of the improved package in the open position.
Figure 4:
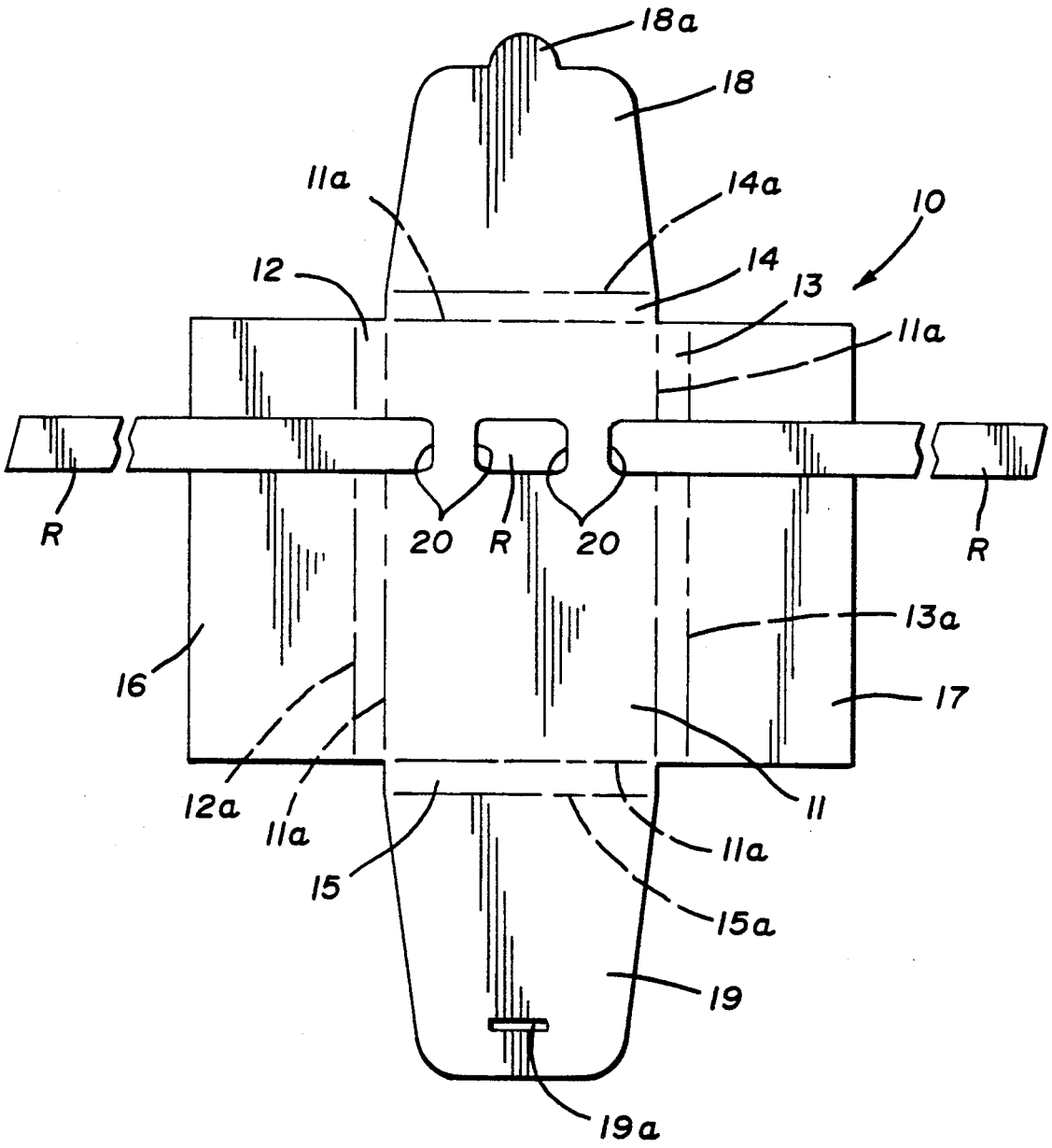
FIG. 4 is a plan view showing the rear of the improved package in the open position.

It will further be understood that the package 10, which is displayed in FIGS. 2 and 4 in a flat, open condition, could be readily die cut to provide its exterior outline configuration and also to impart the various score lines to the material in a relatively inexpensive manufacturing operation. It will also be understood that, due to the nature of the material, it would be readily possible to provide the exterior surface (see FIG. 4) with a decorative coating 20 so as to eliminate the need for additional wrapping paper.

Still referring to FIGS. 1 through 4 of the drawings, it will be noted that the base 11 has a pad 11*b* glued or otherwise affixed thereto and that, in the die cutting operation, two pairs of slots 20,20 are provided through the base 11 and pad 11*b*.

Figure 3:
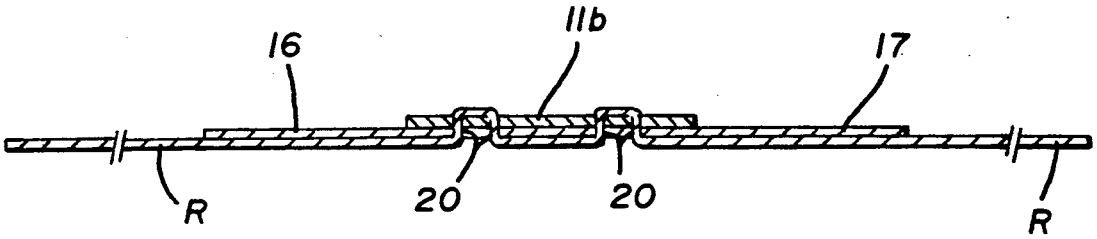
FIG. 3 is a sectional view taken along the line 3—3 of FIG. 2.

Also provided in the improved package is a strap or ribbon R which is threaded through the pairs of slots 20,20, as can readily be seen in FIGS. 2 through 4 of the drawings. This makes it possible, as illustrated in FIG. 2 of the drawings, for the chain, necklace or other jewelry article to be trapped between the portions of the ribbon or strap R which project up from the pad 11*b*. In FIG. 2, the jewelry is indicated by the phantom lines and by the letter J.

Reference to FIG. 4 of the drawings illustrates that the remaining portion of the strap or ribbon R is in overlying relationship with the opposed or outer surface of the base 11 and, as can be seen in FIG. 1 of the drawings, when the side walls 12 and 13 and end walls 14 and 15 are folded so as to be disposed generally normal to the plane of the base 11 and the first, second, third and fourth top flaps 16, 17, 18 and 19 are folded over so as to be generally parallel to the base 11, it is possible to extend the ribbon about the exterior of the assembled package and tie it in a bow or other decorative configuration, as shown in FIG. 1.

Assuming that the material from which the package 10 is made has been imparted with a decorative outer surface 20, the result is a package which is ready for presentation to the recipient of the jewelry article without any further decoration, wrapping or assembly.

While a full and complete description of the invention has been set forth in accordance with the dictates of the Patent Statutes, it should be understood that modifications can be resorted to without departing from the spirit hereof or the scope of the appended claims.

For example, certain material has been referred to as being desirable for the fabrication of the package, but it should be understood that any suitable low-cost material which is durable enough for the purpose for which it is intended could be employed.

Furthermore, it should be understood that, while jewelry has been referred to herein, and while the invention has great utility in the jewelry field, the package could be used to retain any article small enough to effectively lie flat in a package of this nature.

Finally, as previously noted, the package can be secured with the ribbon R alone, dispensing with the lip 18*a* and slot 19*a*.

What is claimed is:

1. A package for jewelry or the like, comprising:

a) a generally rectangular base having inner and outer surfaces and opposed side edges and opposed end edges;

b) first and second side walls foldably attached to said opposed side edges;

c) first and second top flaps foldably attached to said first and second side walls;

d) third and fourth top flaps foldably attached to said opposed end edges;

e) said base having at least two pairs of opposed, spaced apart, through slits;

f) said first and second side walls being foldable to a position substantially normal to the plane of said base;

g) said first and second top flaps being foldable to a position overlying and parallel to said base;

h) said third and fourth top flaps being foldable to a position overlying and parallel to said base and said first and second top flaps;

i) attachment means carried by said third and fourth top flaps for maintaining said flaps in overlying position with respect to said first and second top flaps and said base;

j) elongate jewelry retention means receivable through said slits in said base so as to dispose a portion thereof in overlying relationship with said front surface of said base for confining the jewelry between said retention means and said inner surface of said base;

k) the jewelry consisting of a necklace or chain; and l) said retention means engage a portion of the length of the jewelry.

2. The package of claim 1 wherein said elongate jewelry retention means comprise an elongate band of material.

3. The package of claim 1 wherein said base and said top flaps have inner and outer surfaces; at least the outer surfaces thereof being decorated.

4. A package for jewelry or the like, comprising:

a) a generally rectangular base having inner and outer surfaces and opposed side edges and opposed end edges;

b) first and second side walls foldably attached to said opposed side edges;

c) first and second top flaps foldably attached to said first and second side walls;

d) third and fourth to flaps foldably attached to said opposed end edges;

e) said base having at least two pairs of opposed, spaced apart, through slits;

f) said first and second side walls being foldable to a position substantially normal to the plane of said base;

g) said first and second top flaps being foldable to a position overlying and parallel to said base;

h) said third and fourth top flaps being foldable to a position overlying and parallel to said base and said first and second top flaps;

i) attachment means carried by said third and fourth top flaps for maintaining said flaps in overlying position with respect to said first and second top flaps and said base;

j) elongate jewelry retention means receivable through said slits in said base so as to dispose a portion thereof in overlying relationship with said front surface of said base for confining the jewelry between said retention means and said inner surface of said base;

k) a support pad received on said inner surface of said base;

l) said support pad having complementally disposed through slits;

m) the jewelry consisting of a necklace or chain;

n) said retention means being receivable through said slits in said support pad so as to dispose a portion thereof in overlying relationship with said support pad for confining the jewelry between said retention means and said pad; and o) said retention means engaging a portion of the length of the jewelry.

5. The package of claim 4 wherein aid elongate jewelry retention means comprise an elongate band of material.

6. The package of claim 4 wherein said base and said top flaps have inner and outer surfaces; at least the outer surface thereof being decorated.

* * * * *

UNITED STATES PATENT AND TRADEMARK OFFICE

CERTIFICATE OF CORRECTION

PATENT NO. : 5,219,071

DATED : June 15, 1993

INVENTOR(S) : Robert L. Knapp

It is certified that error appears in the above-identified patent and that said Letters Patent is hereby corrected as shown below:

In Column 1, line 28, delete "sued" and substitute therefor ---used---.

In Column 1, line 52, delete "through" and substitute therefor ---thought---.

In Column 2, line 53, delete "flat" and substitute therefor ---flap---.

In Column 2, line 54, delete "now" and substitute therefor ---not---.

In Column 5, line 5 (Claim 4(d)), delete "to" and substitute therefor ---top---.

In Column 6, line 16 (Claim 5), delete "aid" and substitute therefor ---said---.

Signed and Sealed this

First Day of February, 1994

*Attest:*

Bruce Lehman

BRUCE LEHMAN

*Attesting Officer*

*Commissioner of Patents and Trademarks*